United States Patent [19]

Klatt et al.

[11] 4,309,143

[45] Jan. 5, 1982

[54] VANE-DISK TYPE TURBOMOLECULAR PUMP AND ETCHING METHOD OF MANUFACTURE OF VANE DISKS

[75] Inventors: Karl-Heinz Klatt, Jülich-Stetternich; Eckard Küssel, Düren, both of Fed. Rep. of Germany

[73] Assignee: Kernforschungsanlage Jülich GmbH, Jülich, Fed. Rep. of Germany

[21] Appl. No.: 124,973

[22] Filed: Feb. 27, 1980

Related U.S. Application Data

[63] Continuation of Ser. No. 855,380, Nov. 28, 1977, abandoned.

[30] Foreign Application Priority Data

Nov. 29, 1976 [DE] Fed. Rep. of Germany ..... 2654055

[51] Int. Cl.[3] ..... F01D 1/36

[52] U.S. Cl. ..... 415/90; 415/212 A; 29/156.8 R

[58] Field of Search ..... 415/90, 212 A, 213 C; 29/156.8 R, 156.8 B

[56] References Cited

U.S. PATENT DOCUMENTS

| | | | |
|---|---|---|---|
| 3,020,102 | 2/1962 | Becker | 415/90 |
| 3,477,381 | 11/1969 | Becker | 415/90 |
| 3,749,528 | 7/1973 | Rousseau et al. | 415/90 |
| 3,759,626 | 9/1973 | Becker | 415/90 |
| 3,969,039 | 7/1976 | Shoulders | 415/90 |
| 4,036,565 | 7/1977 | Becker | 415/90 |

OTHER PUBLICATIONS

Hausner, H., *Beryllium its Metallurgy and Property*, Berkeley and Los Angeles, University of California Press, 196, p. 18.

Weast, R., *Handbook of Chemistry and Physics*, Cleveland, OH, CRC Press, 1976, pp. B54–B55.

*Primary Examiner*—Louis J. Casaregola

*Attorney, Agent, or Firm*—Frishauf, Holtz, Goodman & Woodward

[57] ABSTRACT

Metal disks of alloys having a high ratio of tensile strength to specific gravity, such as copper-beryllium and aluminum-containing titanium alloys containing also molybdenum or vanadium or vanadium and chromium, are etched to produce arrays of rotor and stator vanes integral with a mounting rim for a turbomolecular pump. The vanes are set by twisting about a substantially radial axis in the mid-plane of the disk. The angle of set decreses by 35° at the suction side to 10° at the prevacuum side both for the rotor vane arrays and the stator vane arrays that are interleaved. High velocities of rotation and therefore high suction power and extremely low producible vacuum pressures are made possible.

16 Claims, 6 Drawing Figures

VANE-DISK TYPE TURBOMOLECULAR PUMP AND ETCHING METHOD OF MANUFACTURE OF VANE DISKS

This is a continuation of application Ser. No. 855,380 filed Nov. 28, 1977 (abandoned).

This invention relates to a turbomolecular pump of the kind having a turbine rotor and a turbine stator each having a plurality of radial vane arrays that interleaved, the rotor vanes, on the one hand and the stator vanes on the other being set at opposite angles about radially directed axes lying in the median plane of the particular array of rotor or stator vanes.

In order to obtain the desired low pressures of $10^{-3} \times 10^{-10}$ mbar with turbomolecular pumps high relative velocities between rotor and stator vanes are required. The necessary rates of revolution for the turbine rotor are between about $30\times10^3$ and $60\times10^3$ revolutions per minute. The load that a turbomolecular pump can handle, in addition to depending to the relative velocity of the vanes. It is sought to determine the geometry in such a way that the turbomolecular pump will have the maximum suction capability on its high vacuum side and on its opposite side, the pre-vacuum side, will have the maximum possible compression power.

The highest possible rate of revolution of the turbine rotor determines the ratio of tensile strength of the material of the rotor vanes to their specific gravity. The geometry factor of the pumps capability is affected particularly by the angle at which the vanes are set and the so-called overlap degree, i.e. the ratio of the spacing of the vanes, on their disk or annular mounting, to the vane width. Of substantial influence is also the thickness of the rotor and stator vanes. For high suction power an effort is made to utilize vanes that are as thin as possible (compare Vakuumtechnik, 1974, volume 23, number 4, pages 109ff.)

It is known to manufacture turbine rotors and their rims equipped with vanes out of aluminum alloys that not only have a favorable ratio of tensile strength to specific gravity, but also make it possible to produce the set of the vanes by machining with cutting tools. This type of manufacture of turbine rotors and vane arrays is, however, very costly. In order to hold manufacturing costs within limits turbomolecular pumps are provided with vane arrays that are so far as possible identical, or at least comprise only a few kinds that differ from each other principally in the angle at which the vanes are set, resulting in a reduction of the pumping capability of the turbomolecular pumps that is accepted as the price of economic practicality.

From the above cited publication, Vakuumtecnik, 1974, volume 23, number 4, pages 109ff., particularly p. 110, it is known to provide the set of the vanes of the turbine rotor and of the turbine stator after milling out the vane shape by setting (twisting) the vanes through a prescribed "set" angle. In order to increase the loading capability of the rotor vanes, however, the thickness of the vanes is doubled at the vane base, so that the setting of the individual vanes is disadvantageously made difficult. As a result of the extended zone of torsion at the base of the vanes, an undesired backflow must be taken into account at the edge region of the walls of the annular cavity of the turbomolecular pump in which the vanes are held. On that account the suction power of the turbomolecular pump is impaired, as is also the capability of producing extremely low pressures.

THE PRESENT INVENTION

It is an object of the present invention to provide a turbomolecular pump having a suction power and a compression ratio that can be provided at an optimum value while at the same time the manufacturing cost is greatly reduced compared to conventional turbomolecular pumps.

Briefly, the rotor vanes blades of each circular array are connected fast, and preferably made integral, with a rotor disk having a vane-carrying rim and having a thickness that is the same as the thickness of the rotor vanes, and both the rotor disks and the annular stator disks are made of a metallic material that has a ratio of tensile strength to specific weight that is more than $17\times10^3$ m and has a modulus of elasticity greater than $10\times10^3$ kp/mm$^2$. Rotor disks of the embodiments of this invention are advantageously suited for high rates of revolution. They lend themselves to manufacture of thin material, the thickness of the vanes being determined by the thickness of the rotor disk. The turbomolecular pumps of the present invention are distinguished by high circumferential velocities and a favorable geometry factor. Copper-beryllium alloys have been found to be particularly suitable materials for rotor and stator disks. Aluminum-containing titanium alloys are also advantageously usable for these components.

In a further development of the invention it is provided that the rotor vanes of the respective rotor disks affixed to the turbine rotor and the stator vanes of the stator disks affixed to the turbine stator have a stepwise diminishing set angle in the direction of suction of the turbomolecular pump, from rotor disk to rotor disk and likewise from stator disk to stator disk, from 35° at the high vacuum side down to 10° at the prevacuum side. This leads to a further increase of the suction power of the turbomolecular pump and to lower obtainable pressures. The suction power is further raised by providing rotor vanes and stator vanes that have constant vane width from vane base to vane tip, so that in an advantageous manner constant spacing between rotor vanes and stator vanes is provided from vane base all the way to vane tip. It is practical to affix each stator vane to the stator disk by means of a strip of a width smaller than the vane width. The torsion of the stator vanes over an extended region at the vane base in the setting operation and in adjustment of the angle of set of the vanes is thereby largely avoided.

For the manufacture of the rotor and stator disks of the turbomolecular pumps an etching process is advantageously utilized in accordance with the invention. Disks of a metallic material having a thickness corresponding to the designed thickness of the rotor and stator vanes are covered on both sides with etch-resistant masks determining the number of vanes and the vane shape, after which the disks are brought into contact with an etching medium that dissolves the parts of the disks that are not covered by the masks. Then after cleaning the disks of remnants of the etching medium and removal of the masks, the vanes formed by the remaining metal are set by the prescribed angle of set about an axis of twist lying in the median plane of the disk. When this method of manufacture is used, it is advantageously quite unnecessary to perform any machining by cutting tools to produce the rotor and stator disks of the present invention, are made of materials which would be very expensive to machine with cutting tools In a further development of the invention, after the setting of the vanes of the etched rotor and stator disks, the disks with their integral vanes are hardened by heat treatment.

Drawings, Illustrating Examples

DESCRIPTION OF PREFERRED EMBODIMENTS

Figure 1:
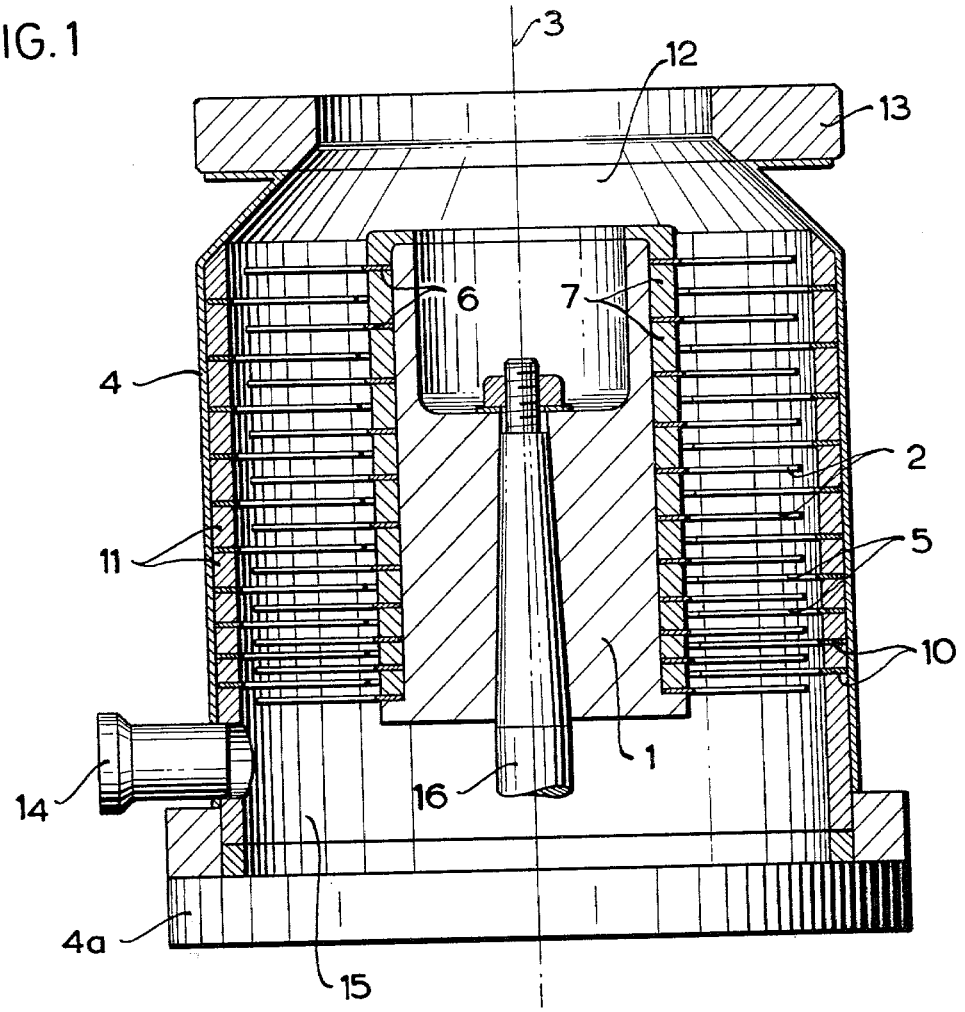
FIG. 1 is a diagrammatic cross-section passing through the turbine axis, of the turbine rotor and the turbine stator of a turbomolecular pump according to the invention.

As shown in the drawings, particularly FIG. 1, the illustrated embodiment of a turbomolecular pump according to the invention comprises as internally located turbine rotor 1 that carries rotor vanes 2 in axially aligned circular arrays and is rotatably driven about a rotor axis 3 at high velocity relative to the stator vanes 5 arrayed in fixed position in the pump casing 4, thereby producing the suction effect. The rotor vanes 2 of each vane array are component portions of rotor disks 2 that are fastened to the turbine rotor between spacing rings 7 that are clamped on the turbine rotor. The thickness 8 of the rotor disks 6 corresponds to and is equal to the thickness 9 (see FIG. 6) of the rotor vanes 2. The stator vanes 5 are carried by the annular stator disks 10. These are clamped to the pump casing 4 between spacing rings 11. The thickness of the stator disks 10 also corresponds and is equal to the thickness of the stator vanes 5. The vanes of this type of turbine, as is evident from FIG. 2–6 are such that they could as well be referred to as blades. Both terms are rather interchangeably used in turbine technology for this type of element.

For gastight connection of a suitable receptacle in which to produce a vacuum, a flange 13 is provided on the suction side of the turbomolecular pump. The tubular fitting 14 for connection to the prevacuum system, not shown in the drawing, that is used in the conventional manner for backing up a high vacuum pump, is affixed to the pump casing near its base at 4*a* the prevacuum end 15 of the casing, which is to say the end of the turbine rotor 1 that is the opposite to its suction side end. The rotor shaft 16 that carries the turbine rotor 1 is held in a bearing (not shown) outside the evacuated space of the pump casing 4. It is connected to a drive motor that is also not shown in FIG. 1.

The rotor disks 6 and the stator disks 10 in the illustrated case both consist of an aluminum-containing titanium alloy. $TiAl_7No_4$ is typically used, which has a ratio of tensile strength to specific weight of the order of magnitude of $20\times10^3$ m and an elasticity modulus of $11.4\times10^3 kp/mm^2$. Titanium alloys are so suitable for the manufacture of rotor and stator disks which contain aluminum and vanadium or aluminum, vanadium and chromium, for example $TiAl_6V_4$ or $TiV_{13}Cr_{11}Al_3$. Along with these there are particularly preferred also alloys that contain copper and beryllium, whose ratio of tensile strength to specific gravity is about $17\times10^3$ and which have an elasticity modulus of the order of magnitude $13\times10^3 kp/mm^2$.

Figure 6:
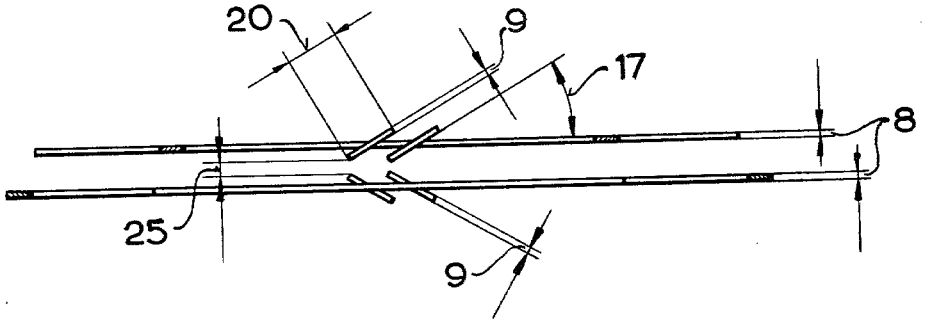
FIG. 6 is a side view of a rotor disk according to FIG. 4 and a stator disk according to FIG. 5 showing in each case only two set vanes.
Figure 2:
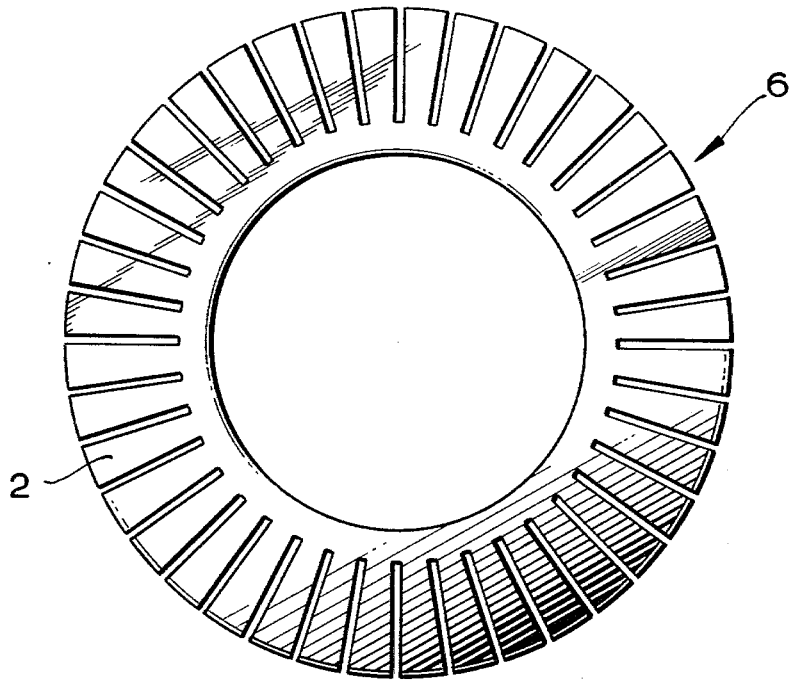
FIG. 2 is a plan view of an unset rotor disk of a turbomolecular pump.

The rotor and stator disks that are alternatingly aligned in the actual direction of the rotor axis 3 in the turbomolecular pump are distinguished from each other in each case by the angle of set 17 of the rotor vanes or stator vanes respectively, as shown in FIG. 6, which shows one rotor disk and one stator disk with two vanes drawn in for illustration.

Figure 4:
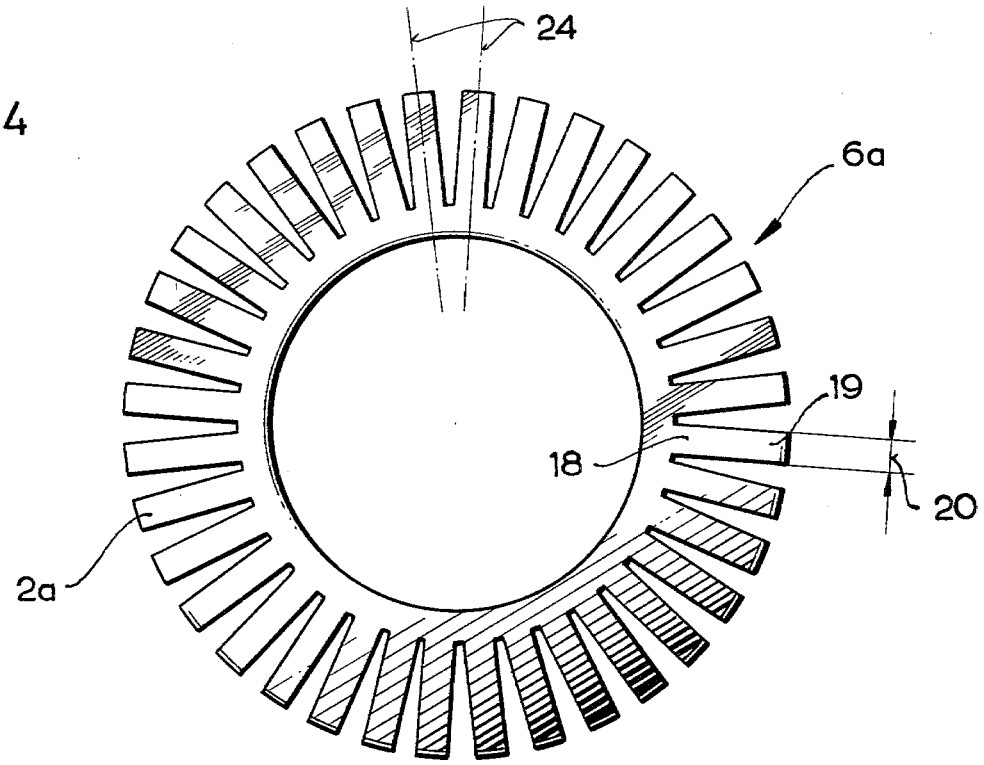
FIG. 4 is a plan view of a rotor disk vanes of constant width, also unset.
Figure 5:
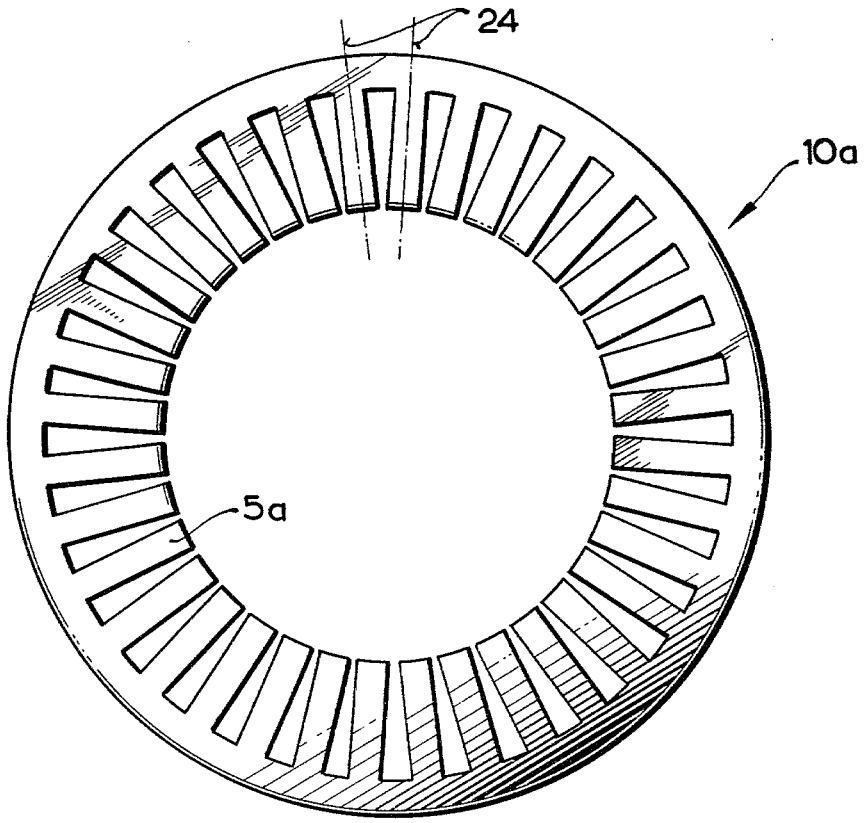
FIG. 5 is a plan view of a stator disk with vanes of constant width, also unset.

From rotor disk to rotor disk and from stator disk to stator disk the angle of set 17 of the vanes diminishes from 35° at the suction side 12 down to 10° at the prevacuum side 15 of the turbomolecular pump, stepwise in even steps. By this configuration of the turbomolecular pump a high suction power is obtained advantageously with a relatively small number of axially aligned rotor and stator disks. An increase in the suction power can additionally be obtained by the installation of rotor and stator disks of the form illustrated diagrammatically in FIGS. 4 to 6. In FIG. 4 a rotor disk 6*a* is illustrated having rotor vanes 2*a* that from vane base 18 out to vane tip 19 have a constant vane width 20. A stator disk 10*a* with correspondingly shaped stator vanes 5*a* is shown in FIG. 5. In the illustrated examples the rotor vanes 2,2*a* and the stator vanes 5,5*a* are designed for an outer diameter of about 115 mm and a thickness of only 0.5 mm.

Figure 3:
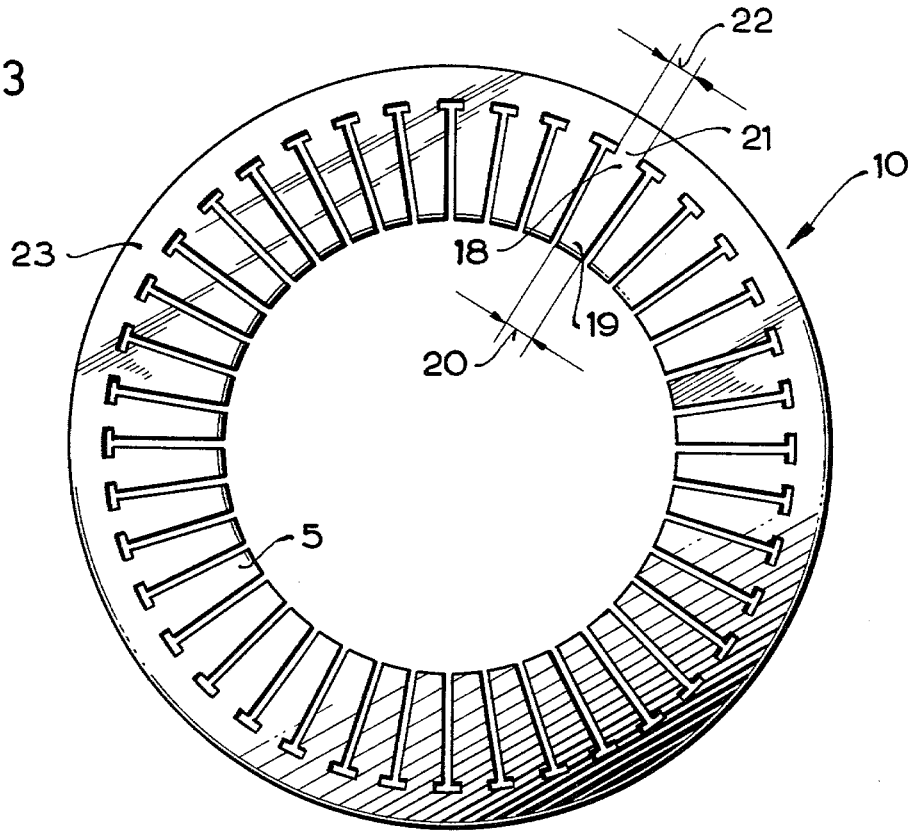
FIG. 3 is a plan view of an unset stator disk of a turbomolecular pump.

FIG. 3 shows a stator disk 10 with still unset stator vanes 5, which have a vane width 20 that increases from the vane tip 19 to the vane base 18. The stator vanes 5 are in each case connected fast to the stator disk 10 by means of a connecting strip 21 that has a width 22 smaller than the vane width at the vane base 18. This attachment of the stator vanes facilitates the setting of the vanes, so that there is only a very narrow torsion zone between the clamped rim 23 of the stator disk 10 and the stator vanes 5, each set at the angle of set 17, a configuration that reduces back flow in the region of the stator disks near the cavity walls and consequently produces an improvement of the suction power in the turbomolecular pump and of the vacuum producible thereby.

The rotor and stator disks according to the invention represented in the drawings are advantageously manufactured by an etching process. Two different processes of this type are given below by way of example:

According to the first illustrative process, the metallic disks are first provided with photosensitive layers on their faces that are exposed through a transparent image of the desired vane shape number and through which light is projected from a source in order to produce a mask corresponding to the image provided, which mask can thereafter be made etch-resistant by well known process steps that need not be described here. The preparation of etch-resistant masks is commonly performed in the semiconductor and printed circuit industries as well as in various of the decorative arts.

The metallic disks provided with etch-resistant masks, thus prepared, corresponding to the number and shape of the vanes to be formed integrally with each disk rim are then brought into contact with a suitable etching medium for the alloy of which the disk consists, for example by squirting the etching medium on to the surface of the disk or by dipping of the disk into the etching liquid. After the portions of the disk not protected by the masks on both sides are dissolved away, the disk is rinsed and thereby freed from the etching medium residues. Then the etch-resistant mask is removed, after which the rotor and stator vanes thus produced on the corresponding disks are set by a rotary movement about an axis 24 (FIGS. 4 to 6) lying in the median plane of the disk, until adjusted to the desired angle of set 17. The axes 24 in the illustrated case are radial, but of course slight variation from exactly radial axes of set could be provided in cases of special design.

According to another manufacturing process the rotor and stator disks can be electrochemically etched. In this case metallic disks of a thickness corresponding to the gauge of the rotor and stator vanes respectively are provided in the same way as above described with etch-resistant masks. The prepared disks are then sprayed with an ionized electrolyte that contains particles, for example graphite particles, that are electrically charged. The particles provide the charge transport to the surface portions not covered by the mask, such charge transport being necessary in order to obtain the solution of the regions of the metallic disks that are to be etched away. With this electrochemical method it is possible to etch the rotor and stator disks electrochemically without connecting the disks themselves with one electrode of an electrical voltage source.

Not only rotor and stator disks of the kind used in pumps of the present invention can be made by the above described etching processes. These process can advantageously be used also for the manufacture of vane arrays and their mounting rims for turbomolecular pumps of conventional construction.

Although the invention has been described with reference to particular examples of configuration and of method of manufacture, it is evident that variations and modifications are possible within the inventive concept.

Typical rotor or stator disk material are for instance the copper-beryllium alloy CuBe2 with 2 wt % Be, total impurity content of other metals below 0.5 wt %.

An appropriate etching fluid is Fe-III-chloride (60%). The material is hardenable by the following treatment: 2–3 h at 310°–330° C.

A typical composition for a titanium-aluminium alloy is: Ti-A16-V4 with 6 wt % Al, 4 wt % V, total impurity content of other metals below 0.5 wt %. An appropriate etching fluid is 50% HF plus 50% $HNO_3$. No heat treatment is required.

Similar treatment is applicable for the following suitable materials: $NiBe_2$, Ti-A15-Sn2,5, Ti-Al17-Mo4 and so on.

Manufacture of disks by electric spark erosion is not possible.

We claim:

1. A turbomolecular pump comprising a turbine rotor and a turbine stator, each carrying a series of arrays or radial turbine vanes disposed one behind the other in axial alignment, the vane arrays of the rotor being interleaved with the fixed vane arrays of the stator which are each connected fast to an annular stator disk, further having the improvement which consists in that:

the rotor disks (6,6*a*) and the stator disks (10,10*a*) consists of a metallic material having a ratio of tensile strength to specific weight greater than $17\times10^3$ m and a modulus of elasticity greater than $10\times10^3$kp/mm$^2$; and each array of rotor vanes is integral with and of the same thickness as the rotor disk, being etched-formed therefrom, the vanes of the array being twisted about a substantially radial axis so that their broad surfaces are at an angle of set that is constant for each array.

2. A turbomolecular pump as defined in claim 1 in which the rotor and stator disks (6,6*a*,10,10*a*), including their vane arrays, consist of a copper-beryllium alloy, and in which each array of stator vanes is integral with and of the same thickness as the stator disk, being etch-formed therefrom, the vanes thereof being twisted about a substantially radial axis so that their broad surfaces are at an angle of set that is constant for each array.

3. A turbomolecular pump as defined in claim 1 in which the rotor and the stator arrays (6,6*a*,10,10*a*), including their vane arrays, consist of an aluminum-containing titanium alloy, and in which easy array of stator vanes is integral with and of the same thickness as the stator disk, being etch-formed therefrom, the vanes thereof being twisted about a substantially radial axis so that their broad surfaces are at an angle of set that is constant for each array.

4. A turbomolecular pump as defined in claim 1 in which the rotor vanes (2,2*a*) and the stator vanes (5,5*a*) have an angle of set (17) that diminishes by steps in the suction direction of the turbomolecular pump from rotor disk to rotor disk and likewise from stator disk to stator disk, from 35° to 10°.

5. A turbomolecular pump as defined in claim 2 in which the rotor vanes (2,2*a*) and the stator vanes (5,5*a*) have an angle of set (17) that diminishes by steps in the suction direction of the turbomolecular pump from rotor disk to rotor disk and likewise from stator disk to stator disk, from 35° to 10°.

6. A turbomolecular pump as defined in claim 3 in which the rotor vanes (2,2*a*) and the stator vanes (5,5*a*) have an angle of set (17) that diminishes by steps in the suction direction of the turbomolecular pump from rotor disk to rotor disk and likewise from stator disk to stator disk, from 35° to 10°.

7. A turbomolecular pump as defined in claim 1 in which the rotor vanes (2*a*) and the stator vanes (5*a*) have a constant vane width (20) from vane base (18) to vane tip (19).

8. A turbomolecular pump as defined in claim 2 in which the rotor vanes (2*a*) and the stator vanes (5*a*) have a constant vane width (20) from vane base (18) to vane tip (19).

9. A turbomolecular pump as defined in claim 3 in which the rotor vanes (2*a*) and the stator vanes (5*a*) have a constant vane width (20) from vane base (18) to vane tip (19).

10. A turbomolecular pump as defined in claim 4 in which the rotor vanes (2*a*) and the stator vanes (5*a*) have a constant vane width (20) from vane base (18) to vane tip (19).

11. A turbomolecular pump as defined in claim 1 in which each stator vane (5) is connected to its stator disk (10) by a means of a strip (21) of which the width (22) is smaller than the vane width at the vane base (18).

12. A method of making rotor and stator disks for a turbomolecular pump, which disks have a thickness (8) equal to the thickness (9) of the vanes connected thereto and are made, as well as their vanes of a metallic material having a ratio of breaking strength to specific weight greater than $17\times10^3$m and a modulus of elasticity greater than $10\times10^3$kp/mm$^2$ comprising the steps of:

making disks of a metallic material of the aforesaid kind;

providing an etching-resistant mask on both sides of each disk defining the vane shape and vane number of the vane array of the disk;

bringing each disk into contact with an etching medium that dissolves the portion of each disk not covered by the masks;

washing away said etching medium and removing the masks from the remainder of the rotor and stator disks and their respective vanes, and twisting each vane of each disk about a substantially radial axis lying in the median plane of the respective disk by a predetermined angle that is constant for all of the vanes of a particular disk.

13. A method as defined in claim 12 in which said predetermined angle is different for each of the rotor disks of a pump and likewise for each of the stator disks of a pump and is not less than 10° nor greater than 35°.

14. A method as defined in claim 11 in which the rotor and stator disks are subjected, after the twisting of the vanes of the disks, to a heat treatment hardening process.

15. A method as defined in claim 12 in which the rotor and stator disks are subjected, after the twisting of the vanes of the disks, to a heat treatment hardening process.

16. A set of vane-carrying disks for service as the rotor and stator disks of a turbomolecular pump having respective interleaved subsets of rotor and stator disks axially aligned, the vanes of each disk being integral with the disk and twisted relative to the disk plane by an angle of set, about a radial axis lying in a radial plane of the vane rim, and having the improvement consisting in that:

(a) the thickness of the disk is in each case the same as that of the vanes;

(b) both the rotor and stator disks are made of a metallic material having a ratio of breaking strength to specific weight higher than $17\times10^3$m and a modulus of elasticity greater than $10\times10^3$kp/mm$^2$, and (c) each disk and vane assembly has the properties of having been made by chemical etching of a disk of said metallic material through the gaps of an etchant-resisting mask providing for the shape and number of the vanes as well as the connection to and adjacent shaping of the remainder of the disk.

* * * * *